US007775792B2

(12) United States Patent
De Boni et al.

(10) Patent No.: US 7,775,792 B2
(45) Date of Patent: Aug. 17, 2010

(54) COMBUSTION HEAD FOR A GAS BURNER

(75) Inventors: Francesco De Boni, Verona (IT); Roberto Marchetti, Settimo Di Pescantina (IT); Flavio Pastorato, Terranegra Di Legnago (IT); Lorenzo De Fanti, Cerea (IT)

(73) Assignee: Riello S.p.A., Legnago (IT)

( * ) Notice: Subject to any disclaimer, the term of this patent is extended or adjusted under 35 U.S.C. 154(b) by 673 days.

(21) Appl. No.: 11/556,784

(22) Filed: Nov. 6, 2006

(65) Prior Publication Data

US 2007/0117057 A1 May 24, 2007

(30) Foreign Application Priority Data

Nov. 7, 2005 (EP) ..... 05425778

(51) Int. Cl.
*F23Q 9/00* (2006.01)
*F23M 3/00* (2006.01)

(52) U.S. Cl. ..... 431/279; 431/278; 431/284; 431/285; 431/8; 431/9

(58) Field of Classification Search ..... 431/8, 431/9, 159, 181, 187, 350, 349, 168, 169, 431/278, 284, 285, 279; 248/542, 543, 292.14, 248/222.51, 222.52
See application file for complete search history.

(56) References Cited

U.S. PATENT DOCUMENTS 836,989 A * 11/1906 Oliver ..... 285/190
1,472,757 A * 10/1923 Holmberg ..... 126/116 R
2,395,276 A * 2/1946 Jordan ..... 431/174
4,505,666 A 3/1985 Martin et al.
5,154,596 A 10/1992 Schwartz et al.
5,238,395 A * 8/1993 Schwartz et al. ..... 431/10
5,562,437 A 10/1996 Gauthier et al.
5,823,764 A * 10/1998 Alberti et al. ..... 431/184
6,402,059 B1 * 6/2002 Benz et al. ..... 239/422
2003/0054303 A1 3/2003 Rabovitser et al.
2004/0195402 A1 10/2004 Joshi

FOREIGN PATENT DOCUMENTS

EP 1 245 904 10/2002
NL 1011814 10/2000

* cited by examiner

*Primary Examiner*—Kenneth B Rinehart
*Assistant Examiner*—Daniel A Bernstein
(74) *Attorney, Agent, or Firm*—Baker & Daniels LLP

(57) ABSTRACT

A combustion head comprising:

a pipe, having a central axis of symmetry, suitable for conveying a flow of comburent air in a combustion chamber, and a plurality of gas tubes spaced out along a circumference.

Each gas tube has a first portion, having an axis of symmetry parallel to the axis, and a second portion, placed in series with respect to the first portion. The second portion in inclined at an angle with respect to the axis.

11 Claims, 4 Drawing Sheets

SECT. A-A

COMBUSTION HEAD FOR A GAS BURNER

This invention refers to a combustion head for burners particularly suited to achieving the combustion of gaseous fuels with low NOx emission.

BACKGROUND OF THE INVENTION

It is known that the combustion reaction between fuel and comburent in gas burners is achieved by means of a combustion head that substantially comprises a tubular duct, which conveys the comburent fluid originating from a blower to the combustion chamber where it mixes with a gaseous fuel delivered by means of one or more nozzles.

An ignition device of known type sparks off the mixture, thereby starting the combustion.

Likewise, it is known that one of the main problems with combustion heads, from the environmental-impact viewpoint, consists in that they produce nitric oxides NOx during combustion, which cause pollution.

Study of the phenomena of producing nitric oxides NOx has shown that they are chiefly generated when the flame temperature is high. In fact, it has been experimentally observed that NOx production increases in a substantial manner when the flame is around 1200-1400° C.

For this reason, burners have been developed with combustion heads in which reduction of flame temperature takes place by recirculating part of the smoke produced during combustion inside the combustion head where the flame is present.

In fact, the smoke present in the combustion chamber is attracted to the flame and, as it does not take part in the combustion reaction, it absorbs heat, cooling the flame and thereby reducing nitric oxide NOx emissions.

SUMMARY OF THE INVENTION

This invention has the main object of embodying a gas combustion head, to be used in a gas burner, in which a different solution from that of simple smoke recirculation is adopted for lowering the flame temperature, with the object of reducing the production and emission of NOx.

Therefore, in accordance with this invention, a combustion head for gaseous fuels is embodied according to the characteristics specified in the attached Claims.

BRIEF DESCRIPTION OF THE DRAWINGS

This invention will now be described with reference to the enclosed drawings, which illustrate a non-limitative example of embodiment, in which.

DETAILED DESCRIPTION OF THE INVENTION

In the enclosed figures, a combustion head forming the subject of this invention is indicated as a whole by reference 100.

Figure 1:
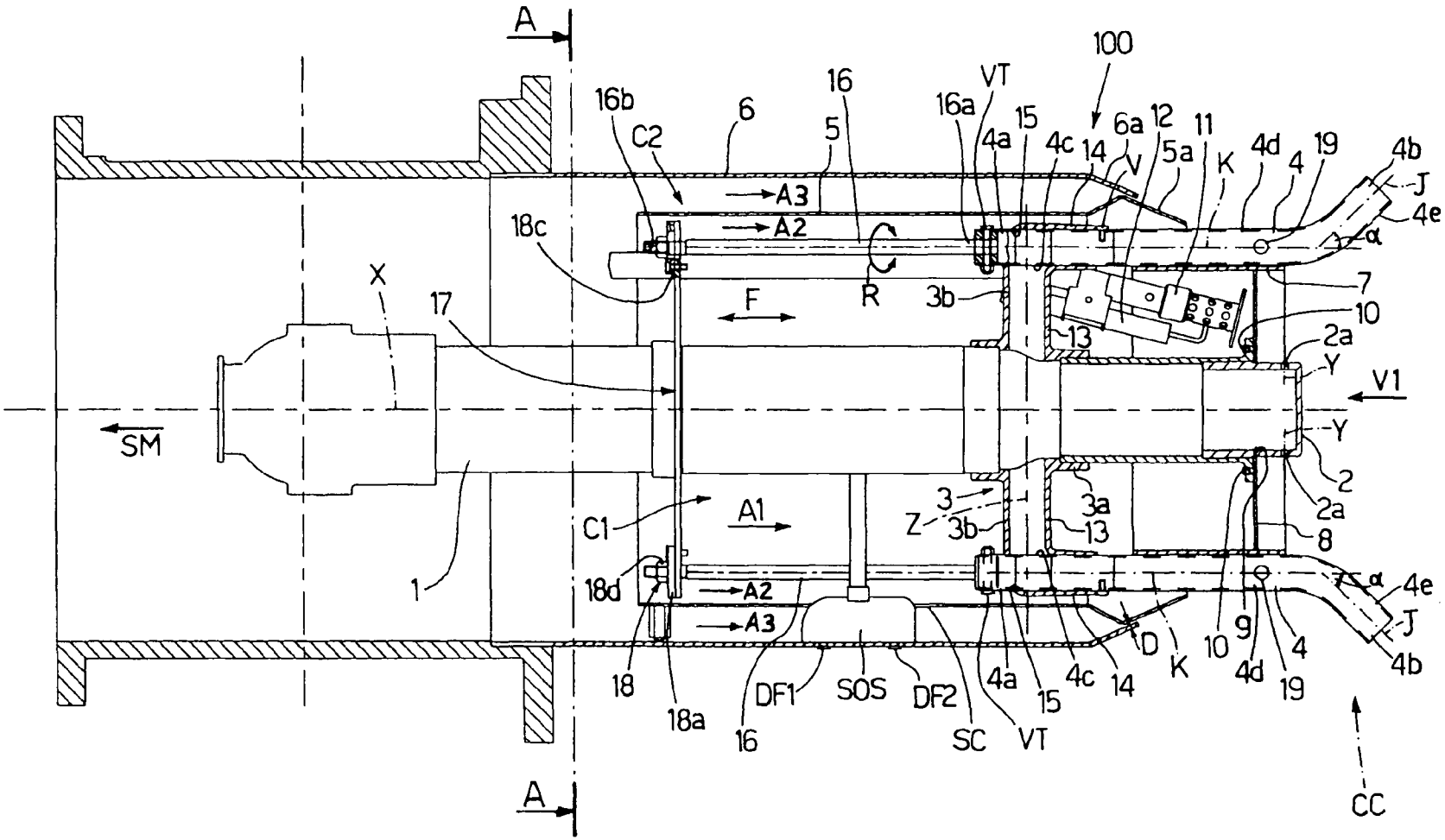
FIG. 1 illustrates a longitudinal section of the combustion head forming the subject of this invention.

As shown, always with reference to FIG. 1, a primary gaseous fuel (methane, for example) is sent through a central pipe 1 (having a longitudinal axis of symmetry X) to a nozzle 2.

In the known manner, the nozzle 2 is able to inject the primary gaseous fuel in output from a plurality of holes 2*a* into a combustion chamber CC (see further on). In the embodiment shown in FIG. 1, the axes Y of the holes 2*a* are perpendicular to axis X.

Figure 2:
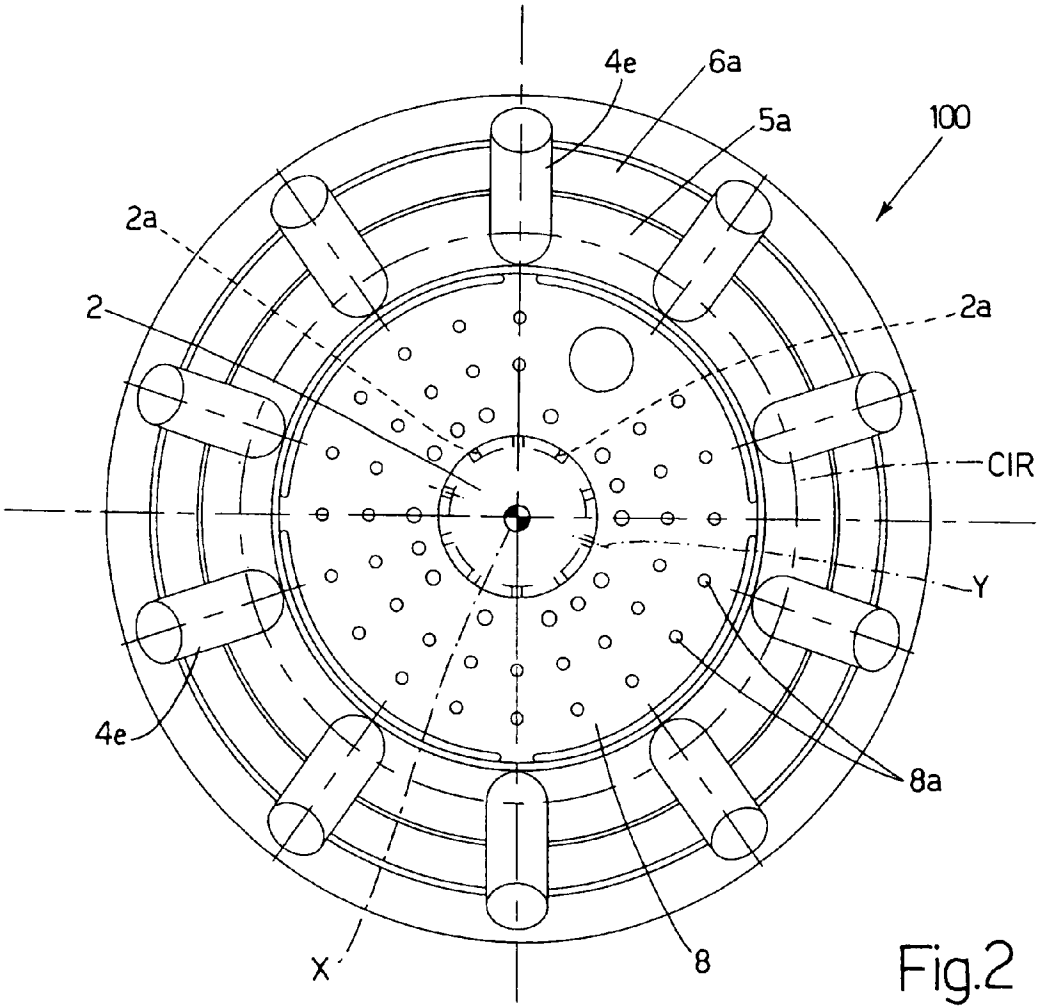
FIG. 2 is a head-on front view (along arrow V1) of the combustion head represented in FIG. 1.

A gas distributor 3 is coaxially fixed on this pipe 1, which, as will be better seen further on, is suitable for distributing the gas fuel arriving from a plurality of gas tubes 4, preferably but not necessarily arranged in a spaced-out manner on a circumference CIR (FIG. 2). Each gas tube 4 has a first end 4*a*, facing towards the inside of the combustion head 100, and a second end 4*b* facing, instead, towards the combustion chamber CC.

An intermediate pipe 5 (coaxial to both the central pipe 1 and the gas distributor 3) with an internal diameter greater than that of the circumference CIR is provided on the outside of the plurality of gas tubes 4. This intermediate pipe 5 has a taper 5*a*, the purposes of which will be specified further on.

Thus, between the central pipe 1 and the intermediate pipe 5, a first feed channel C1 of comburent fluid (air, for example) to the combustion chamber CC is defined.

In addition, the intermediate pipe 5 is able to slide in one of the two axial directions defined by the arrow F. Actually, to make the intermediate pipe 5 slide, an operator, or an actuator (not shown), uses a bracket (not shown) connected to the intermediate pipe 5.

Finally, always coaxial to the axis X, the central pipe 1, the gas distributor 3, and to the intermediate pipe 5, an outer pipe 6 is provided which terminates with a truncated-cone profile 6*a* at the free end facing the combustion chamber CC.

As shown in FIG. 1, the central pipe 1 rests on a support SOS (which passes through an opening SC made in the intermediate pipe 5) fixed to the outer pipe 6 via two screws DF1 and DF2. From what has been previously said, it follows that a second feed channel C2 of comburent fluid (air, for example) to the combustion chamber CC is defined between the intermediate pipe 5 and the outer pipe 6.

The quantity of comburent fluid injected into the combustion chamber CC through the second channel C2 is controlled by varying a distance D between the taper 5*a* and the truncated-cone profile 6*a*. The intuition that it is sufficient to move the intermediate pipe 5 along one of the directions indicated by the arrow F to vary the distance D is immediate.

As shown, always with reference to FIG. 1, a cylindrical sleeve 7 is provided between the central pipe 1 and the gas tubes 4.

A circular crown-shaped disc 8 is welded to the cylindrical sleeve 7. The disc 8 lies on a plane perpendicular to the axis X and has a number of holes 8*a*, visible in FIG. 2. Furthermore, the disc 8 has a central hole 9, through which the central pipe 1 passes when in use. The disc 8, and therefore the cylindrical sleeve 7, is fixed to the central pipe 1 by means of a number of screws 10 in proximity to the nozzle 2.

As illustrated in FIG. 1, the combustion head 100 is equipped with a combustion device 11 able to provide a pilot light near the nozzle 2 and a traditional type of piezoelectric ignition device 12.

Figure 3:
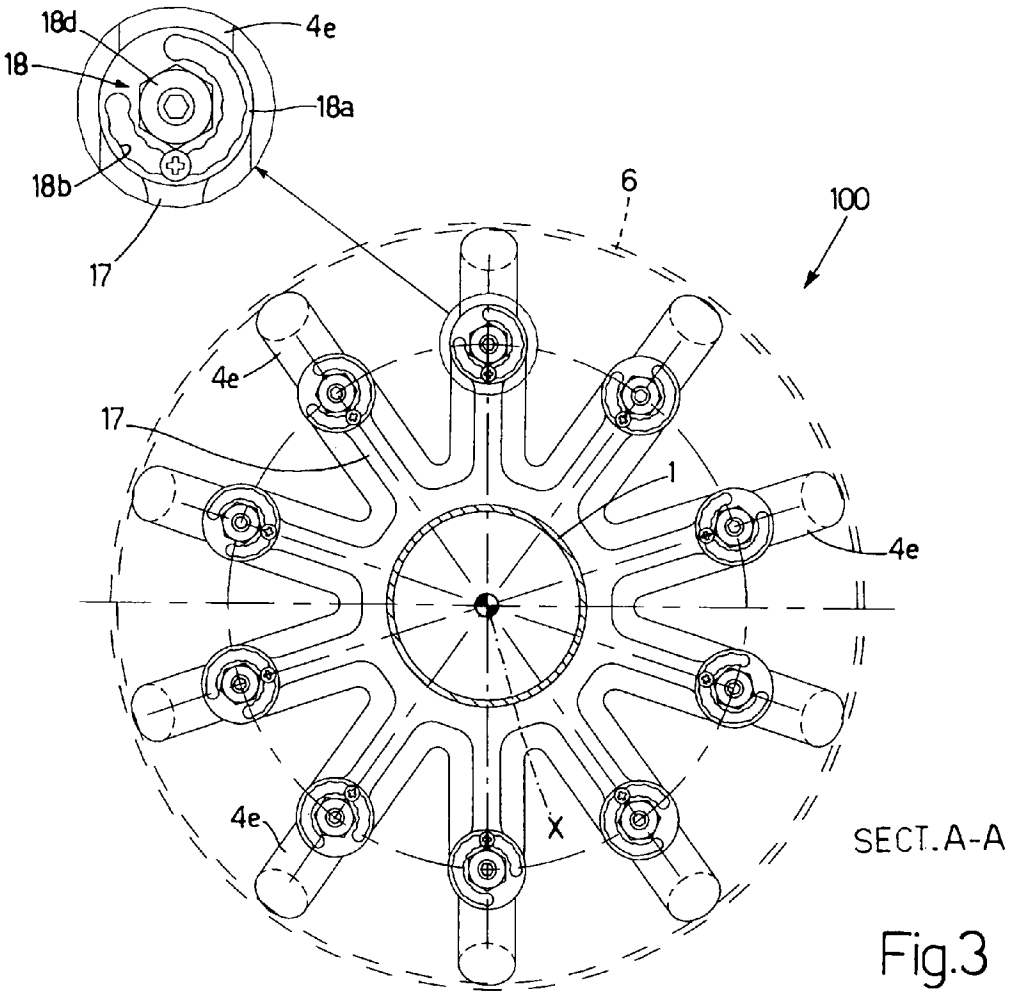
FIG. 3 shows a section A-A made on the combustion head depicted in FIG. 1.

As shown in FIGS. 1 and 3, the gas distributor 3 includes a central hub 3*a* (through which the central pipe 1 passes) from which gas feed pipes 3*b* radiate that are able to transfer part of the combustible gas from the central pipe 1 to the gas tubes 4 spaced out along the circumference CIR (FIG. 2).

In the case in object, by observing FIGS. 2 and 3, it can be deduced that the number of gas tubes 4 is ten. Hence, the number of gas feed pipes 3*b* must also be ten.

To facilitate some of the operations that will be explained further on, each gas tube 4 has an aperture 4*c* near to its end 4*a*.

Furthermore, each gas feed pipe 3*b* has a vertical section 13, with a central axis of symmetry Z perpendicular to axis X, and a horizontal section 14, with a central axis of symmetry K parallel to axis X. The sections 13 and 14 are placed in series with respect to each other.

The junction region between the vertical section 13 and the horizontal section 14 has a circular hole 15, through which the corresponding gas tube 4 passes when in use (FIG. 1).

As illustrated in FIG. 1 in particular, each gas tube 4 has a horizontal portion 4*d*, the central axis of symmetry of which coincides with axis K (parallel to axis X), and a portion 4*e*, the central axis of symmetry J of which is inclined at an angle $\alpha$ with respect to said axis K. The angle $\alpha$ advantageously has values in the range between 0° and +90°. One end 16*a* of a respective control rod 16 is fixed to each gas tube 4 by means of respective screws VT (FIG. 1). The other end 16*b* of the control rod 16 rests on a support structure 17 positioned inside the intermediate pipe 5. The support structure 17 essentially lies on a plane perpendicular to axis X. The axis of the control rod 16 essentially coincides with axis K.

To prevent the gas tubes 4 from moving along the two directions of the arrow F, each gas tube 4 is equipped with a screw V perpendicular to axis K, abutting on the final portion of the section 14. The screw V allows just the rotation of each gas tube 4 around axis K in the direction of a double-headed arrow R.

As shown in FIGS. 1 and 3, each end 16*b* of each rod 16 is equipped with a rotational and locking device 18.

This device 18 includes a plate 18*a* welded to the rod 16, a groove 18*b* (possibly graduated) (FIG. 3) made on the support structure 17, an indicator element 18*c* engaged in the groove 18*b*, and a clamping element 18*d* composed of a bolt that, when screwed on a threaded portion of the rod 16 itself, fixes the latter to the support structure 17.

In fact, an operator can adjust the position of the end 4*b* of any gas tube 4 in the combustion chamber CC by simply unscrewing the corresponding clamping element 18*d*, and turning the relative rod 16 in one of the two directions identified by the arrow R. Once the desired configuration is achieved, its detection aided perhaps by the position of the indicator element 18*c*, the operator only needs to tighten clamping element 18*d* again.

Working in this way, the positions of the ends 4*b* of the gas tubes 4 remain unchanged until a further adjustment becomes necessary.

Obviously, to assure combustion with low NOx emissions, the operator can change the positions of all the ends 4*b*, or just some of them.

In fact, the operator can empirically measure the characteristics of the smoke discharged in the flue (not shown) and consequently adjust the positions of the ends 4*b* inside the combustion chamber CC to achieve emissions with low NOx content.

Incidentally, it can be mentioned that the presence of the aperture 4*c* on each gas tube 4 allows rotation of the gas tube 4 itself without interruption of the gas feed from the central pipe 1 to the end 4*b*.

Moreover, each tube 4 can be provided with one or more holes 19 perpendicular to axis K. A certain quantity of gas comes out from these holes 19, which mixes mainly with air coming from the duct C1.

Figure 5:
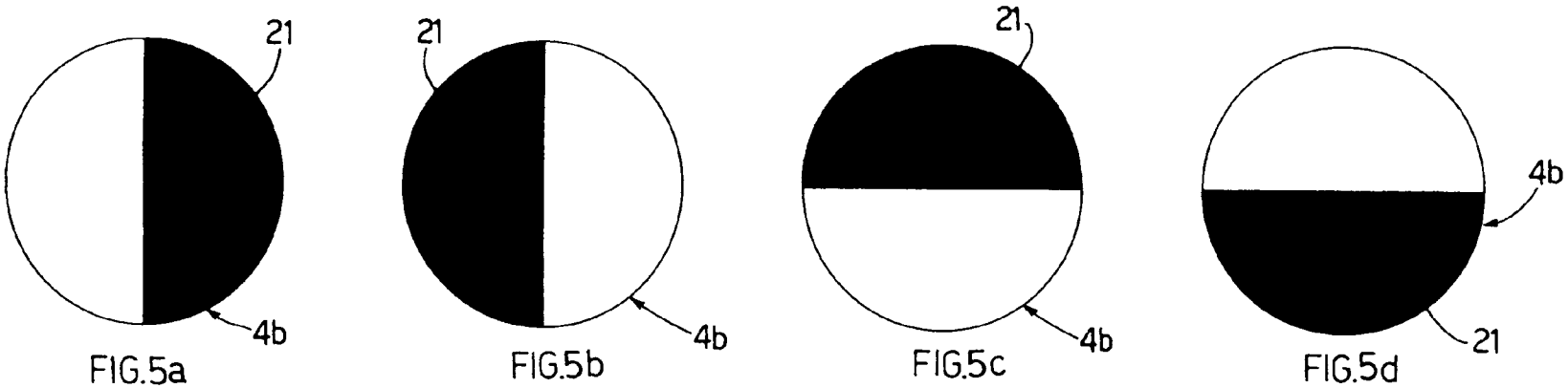
FIG. 5 shows a second embodiment of a final part (in the various configurations that it can assume during use) of a plurality of gas tubes utilized in the combustion head as per FIGS. 1, 2 and 3.
Figure 4:
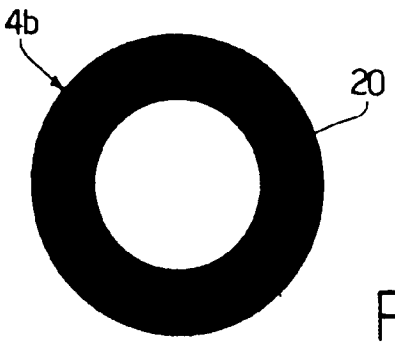
FIG. 4 illustrates a first embodiment of a final part of a plurality of gas tubes utilized in the combustion head as per FIGS. 1, 2 and 3.

Alternative solutions regarding the ends 4*b* of the gas tubes 4 are shown in FIGS. 4 and 5.

In particular, FIG. 4 shows a solution in which the end 4*b* of every gas tube 4 has a circular crown-shaped element 20 able to limit the quantity of secondary gas entering the combustion chamber CC and/or increase the speed of the gas in output.

In FIG. 5 another embodiment is adopted, which provides a semicircular-shaped element 21 able to limit the quantity of secondary gas entering the combustion chamber CC and to direct the same secondary gas jet.

More in detail, it should be noted that FIGS. 5*a*, 5*b*, 5*c* and 5*d* are nothing other than four different configurations in relation to the position assumed by the end 4*b* after turning the corresponding rod 16 in one of the two directions indicated by the arrow R. It is evident that to be able to assume all four of the configurations shown in FIGS. 5*a*, 5*b*, 5*c* and 5*d*, the groove 18*b* must extend for an entire 360° angle.

Also, when the operator wants to disassembly the components of the head 100 that are inside the intermediate pipe 5, all that is needed is to turn all of the gas tubes 4 so that they are within the transversal space occupied by the truncated-cone profile 6*a* of the intermediate pipe 5.

At this point, after having disconnected the central pipe 1 from the gas supply plant (not shown), the operator withdraws all of the elements inside the intermediate pipe 5 towards the rear of the combustion head 100 in the direction and sense identified by the arrow SM.

Therefore, this invention not only provides easy and accurate combustion regulation to give low NOx content emissions, but also gives an extremely simple solution to the problem of disassembling many of the elements included in the combustion head 100.

In fact, the injection of combustible gas by means of the gas tubes 4 in an external zone with respect to the central flame, the central flow of main air coming from the duct C1 and the peripheral flow of secondary air coming from duct C2, allows so-called combustion "staging" to be achieved, also cooling the flame itself so that it remains below 1200° C., the limit beyond which NOx formation is uncontrollable.

In a further embodiment not shown, the regulation of the position of the end 4*b* is not just angular according to the arrow R described up to now, but also axial, as the respective gas tube 4 also moves in the direction and senses defined by the arrow F.

In another embodiment not shown, neither the central pipe 1, nor, still less, the intermediate pipe 5, is provided in the head 100. In this embodiment, all of the air is channelled in the outer pipe 6 and the combustible gas is distributed by just the gas tubes 4 arranged on the circumference CIR.

In use, in the embodiment shown in the enclosed figures, a fan (not shown) provides an adequate flow of comburent fluid (air, for example), which is channelled in the outer pipe 6 that effectively encloses all of the combustion head 100.

This airflow is subsequently divided, thanks to the special geometry of the previously described combustion head 100, into three partial flows respectively named primary air A1, secondary air A2 and tertiary air A3 (FIG. 1).

In particular, primary air A1 and secondary air A2 flow in duct C1, while tertiary air A3 is transported via duct C2 (FIG. 1).

The primary air A1 is sent to the nozzle 2 and distributed in a homogeneous manner thanks to the presence of holes 8*a* in the disc 8 (FIG. 2). In fact, the mixing of the combustible gas leaving the holes 2*a* with the air arriving from the holes 8*a* takes place close to the disco 8. Therefore, the ignition of the gas/air mixture and the formation of the primary flame take place precisely in the zone of the disc 8.

In the known manner, the secondary air A2 in output from the region between the taper 5*a* and the outer surface of the cylindrical sleeve 7 mixes with the combustible gas in output from the holes 19 of the gas tubes 4, and laps the primary combustion zone to give rise to secondary combustion.

The tertiary air A3 also takes part in the combustion in the known manner, entering the combustion chamber CC through the region between the taper 5*a* and the truncated-cone profile 6*a*. As already stated, the breadth of this region is adjustable by varying the value of D (FIG. 1), making the intermediate pipe 5 advance or withdraw via known systems.

The main novelty of this invention consists of the introduction of a considerable portion of secondary gas through a plurality of gas tubes 4. Thanks to the fact that at least a portion 4*e* of each gas tube 4 is inclined, the secondary gas is introduced into the combustion chamber CC in the peripheral zone of the flame. This allows the flame itself to be cooled, with consequent low production of harmful NOx.

The advantages of this invention can therefore be summarized as:

- improvement in combustion with low NOx production, having provided for the introduction of secondary gas in the peripheral region of the flame, external to the flow of comburent air,
- possibility of obviating problems of combustion instability by turning and/or translating at least one gas tube in the directions and senses identified by the arrows R and F,
- ease of regulation of combustion, by carrying out rotations (and/or translations) on each gas tube, and
- facilitate disassembly of the combustion head, as all of the gas tubes can be turned so that they fall within the transverse space occupied by the outer pipe of the combustion head.

The invention claimed is:

1. A combustion head for a gas burner comprising:

a pipe, having a central axis of symmetry (X), able to transfer a flow of comburent fluid into a combustion chamber, and a plurality of gas tubes able to carry combustible gas into said combustion chamber (CC), said gas tubes being arranged along a circumference (CIR);

wherein each gas tube has a first portion having an axis (K) of substantial symmetry, said axis (K) being substantially parallel to said axis (X), said gas tubes being rotatable about their respective axes (K), and each gas tube has a second portion in series with respect to said first portion, said second portion being inclined at an angle ($\alpha$) in the range of from 0° to +90° with respect to said axis (K);

wherein a first end of a respective control rod is fixed to each said gas tube and adapted to make said gas tube turn about its axis (K);

wherein a second end of said control rod rests on a support structure and said second end of each rod is provided with a respective rotational and locking device; and wherein said rotational locking device includes a plate welded to said rod, a groove that is part of the plate, an indicator element cooperating with said rod engaged in said groove and a clamping element.

2. A combustion head as claimed in claim 1, wherein each said gas tube is equipped with at least one lateral hole.

3. A combustion head as claimed in claim 1, wherein one end of each said gas tube has a circular crown-shaped element.

4. A combustion head as claimed in claim 1, wherein one end of each said gas tube has a semicircular-shaped element.

5. A combustion head as claimed claim 1, including:

a central pipe, with a central axis of symmetry (X), fed with a combustible gas, having a nozzle at one end for injecting the combustible gas into the combustion chamber, an intermediate pipe, coaxial and external to said central pipe, with which it defines a first duct able to carry a first comburent air flow and a second comburent air flow to said combustion chamber, and an outer pipe arranged coaxially to said intermediate pipe with which it defines a second duct able to carry a tertiary flow of comburent fluid to said combustion chamber.

6. A combustion head as claimed in claim 5, including a gas distributor between said central pipe and said gas tubes, said gas distributor adapted to transfer a portion of combustible gas arriving from said central pipe to said gas tubes.

7. A combustion head as claimed in claim 6, wherein said gas distributor includes a central hub from which gas feed pipes radiate that are able to transfer part of the combustible gas from the central pipe to the gas tubes spaced out along a circumference (CIR).

8. A combustion head as claimed in claim 1, wherein each said gas feed pipe has a vertical section with a central axis of symmetry (Z) perpendicular to said axis (X), and a horizontal section with a central axis of symmetry (K) parallel to said axis (X), said sections being placed in series with respect to each other.

9. A combustion head as claimed in claim 8, wherein a junction region of said vertical section with said horizontal section is provided with a circular hole through which the corresponding gas tube passes when in use.

10. A combustion head as claimed in claim 6, wherein each said gas tube has an aperture.

11. A gas burner including the a combustion head as claimed in claim 1.

* * * * *